US009259630B2

(12) United States Patent
Fisher

(10) Patent No.: US 9,259,630 B2
(45) **Date of Patent: *Feb. 16, 2016**

(54) PERSONAL ATHLETIC TRAINING DEVICE

(71) Applicant: Robert L. Fisher, Westlake, OH (US)

(72) Inventor: Robert L. Fisher, Westlake, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/461,864

(22) Filed: Aug. 18, 2014

(65) Prior Publication Data

US 2014/0357429 A1 Dec. 4, 2014

Related U.S. Application Data

(63) Continuation of application No. 13/201,037, filed as application No. PCT/US2010/023850 on Feb. 11, 2010, now Pat. No. 8,808,117.

(60) Provisional application No. 61/151,978, filed on Feb. 12, 2009.

(51) Int. Cl.

| | |
|---|---|
| ***A63B 69/00*** | (2006.01) |
| ***A63B 59/18*** | (2006.01) |
| ***A63B 49/18*** | (2006.01) |
| ***A63B 59/08*** | (2006.01) |
| ***A63B 59/00*** | (2015.01) |

(52) U.S. Cl.

CPC ..... *A63B 69/00* (2013.01); *A63B 49/18* (2013.01); *A63B 59/0074* (2013.01); *A63B 59/18* (2013.01); *A63B 59/0029* (2013.01); *A63B 59/0092* (2013.01); *A63B 59/08* (2013.01); *A63B 2209/00* (2013.01)

(58) Field of Classification Search

CPC .... A63B 59/00; A63B 59/0029; A63B 59/18; A63B 59/185; A63B 59/0074; A63B 59/08; A63B 59/0092; A63B 2209/00; A63B 49/18; A63B 69/00

USPC ..... 473/524, 527, 528, 459, 463; D21/729, D21/731

See application file for complete search history.

(56) References Cited

U.S. PATENT DOCUMENTS

| | | | | | |
|---|---|---|---|---|---|
| 3,162,443 | A * | 12/1964 | Petri | 473/528 |
| D340,271 | S * | 10/1993 | Chou | D21/731 |
| 5,253,874 | A * | 10/1993 | Hoffman | 473/514 |
| 5,755,633 | A * | 5/1998 | Marquez | 473/463 |
| 8,808,117 | B2 * | 8/2014 | Fisher, III | 473/459 |
| 2011/0312449 | A1 * | 12/2011 | Fisher | 473/463 |
| 2013/0296081 | A1 * | 11/2013 | Auzoux | 473/463 |

* cited by examiner

*Primary Examiner* — Raleigh W Chiu
(74) *Attorney, Agent, or Firm* — Tucker Ellis LLP

(57) ABSTRACT

An athletic paddle training apparatus 10 includes an elongate handle portion 20, a coupling region 30 at a distal end 22 of the paddle portion, and a game play head 40 operatively coupled with the handle portion 20 at the coupling region 30. The elongate handle portion is configured to be gripped by an associated user. The game play head 40 has first 46 and second 48 game play regions on opposite first 42 and second 44 sides thereof. The first game play region 46 defines a substantially planar first game play surface 56 on the first side 42 and the second game play region 48 defines a substantially spherical second game play surface 58 on the second side 44 of the game play head 40. In an example embodiment, the second game play surface 58 has a likeness of a #5 soccer ball.

14 Claims, 4 Drawing Sheets

PERSONAL ATHLETIC TRAINING DEVICE

CROSS REFERENCE TO RELATED APPLICATIONS

The present application claims priority to U.S. patent application Ser. No. 13/201,037 filed on Aug. 11, 2011 and U.S. Provisional Application Ser. No. 61/151,978, filed on Feb. 12, 2009.All of which is incorporated herein by reference.

TECHNICAL FIELD

The present disclosure relates generally to personal athletic training apparatus and, in particular, to a paddle-type personal athletic training apparatus suitably configured for athletic training.

BRIEF DESCRIPTION OF THE DRAWINGS

The accompanying drawings incorporated herein and forming a part of the specification illustrate the examples embodiments.

OVERVIEW OF EXAMPLE EMBODIMENTS

Figure 1:
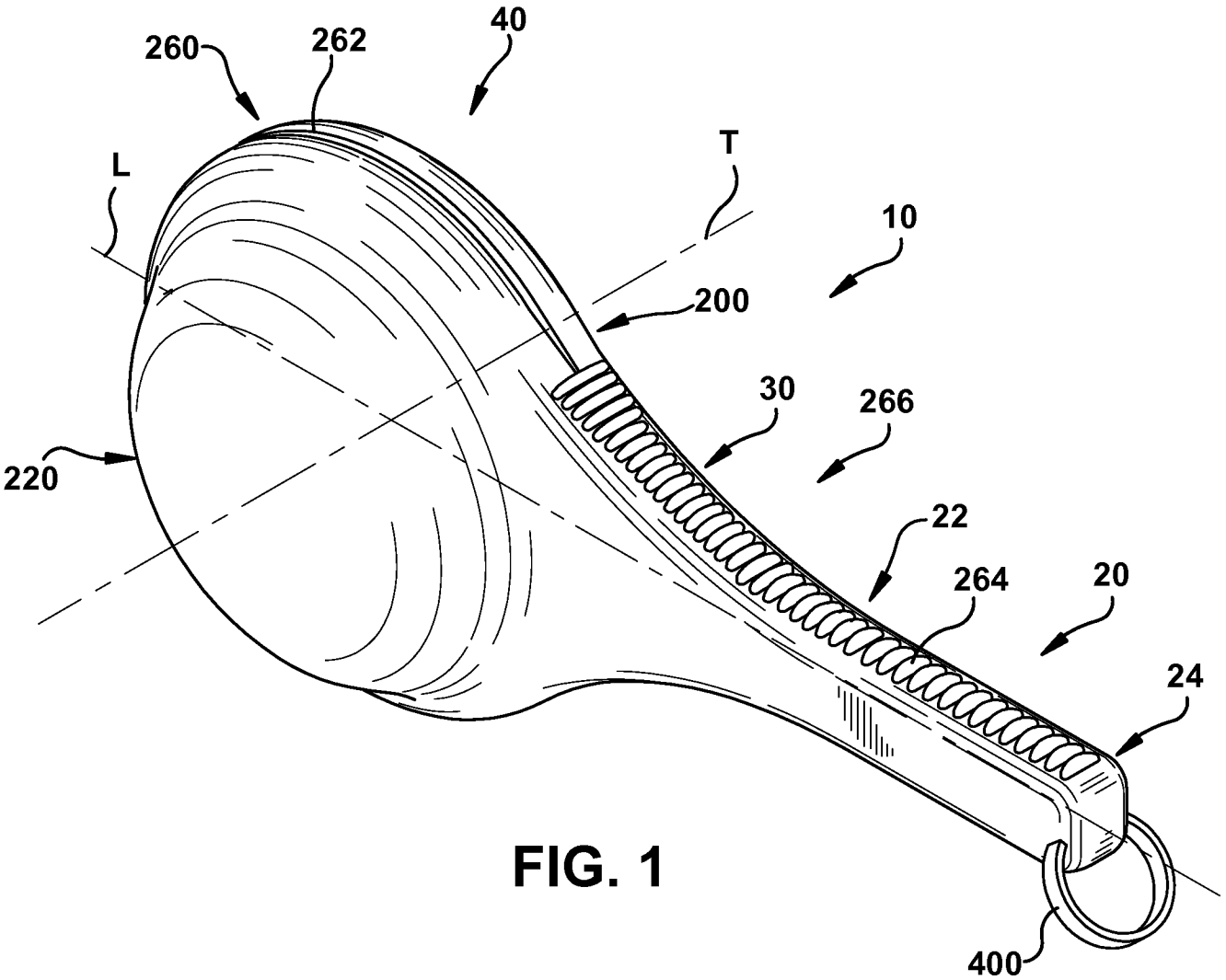
FIG. 1 is a perspective view of an athletic training paddle in accordance with an example embodiment.

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein, a sport specific training device. The training device has a paddle design or shape, wherein one side of the paddle comprises an insert to enable the shape of the apparatus to mimic a desired shape, such as the shape of a #5 soccer ball. In an example embodiment, the insert portion of the subject device is filled with one or more of a polyethylene foam, a dense crepe foam and/or a plastic filler so that the portion of the device has desirable resiliency and other characteristics. The insert portion may be selectively removed and replaced with other materials and/or fillers so that the selected portions of the device can have any selectable resiliency, dampening, spring, compressibility or other characteristics as desired.

In accordance with a further an example embodiment, there is disclosed herein, an athletic paddle training apparatus including an elongate handle portion, a coupling region at a distal end of the paddle portion, and a game play head operatively coupled with the handle portion at the coupling region. The elongate handle portion defines a longitudinal axis and is configured to be gripped by an associated user. The game play head has first and second game play regions on opposite first and second sides thereof in a direction substantially transverse the longitudinal axis. The first game play region defines a substantially planar first game play surface on the first side and the second game play region defines a substantially spherical second game play surface on the second side of the game play head. The second game play surface is laterally offset by a predetermined selected distance relative to the longitudinal axis of the handle portion. In an example embodiment, the second game play surface has a likeness replicating a #5 soccer ball. However, the second game play surface can be fashioned to have a likeness replicating any other item or shape as desired. Further, in the example embodiment, an insert portion is selectively removable and replaceable with other materials and/or fillers so that the selected portions of the device can have any selectable resiliency, dampening, spring, compressibility or other characteristics as desired.

Description of Example Embodiments

This description provides examples not intended to limit the scope of any is claims on applications claiming priority to this application. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

Referring to the drawings, described in an example embodiment herein is a sport specific training device. The device is generally flat on one side, and generally rounded on the opposite side. In a particular embodiment, the rounded size has dimensions and likeness replicating a #5 soccer ball. This design allows for more padding/stuffing inserts to be used with/in the device, thus giving superior shock absorption, safety and durability characteristics.

In an example embodiment, the device comprises a leather or vinyl outer shell with reinforced handle, double stitched along all stress seams with elastic strap. It's innards (inserts) of the paddle training and exercise device are a unique combination of polyethelene and dense crepe foam, along with plastic fillers.

With reference to drawing FIGS. 1-8 in particular, an athletic paddle training apparatus 10 in accordance with an example embodiment includes an elongate handle portion 20 defining a longitudinal L axis and having opposite distal 22 and proximal 24 ends. The handle portion 20 is configured to be gripped by an associated user when exercising or training using the apparatus 10. A coupling region 30 is disposed at the distal end 22 of the paddle portion, and a game play head 40 is operatively coupled with the handle portion 20 at the coupling region 30. In the illustrated embodiment, the game play head 40 has a first game play region 46 and a second game play region 48. The first and second game play regions 46, 48 are located on opposite first 42 and second 44 sides of the game play head 40 in a direction T substantially transverse the longitudinal axis L.

The subject athletic paddle training apparatus 10 in accordance with the example embodiment has a unique shape and structure. In this regard, the first game play region 46 defines a substantially planar first game play surface 56 on the first side 42 of the game play head 40, and the second game play region 48 defines a substantially spherical second game play surface 58 on the second side 44 of the game play head 40. In an example embodiment, the second game play surface 58 is laterally offset by a predetermined selected distance D relative to the longitudinal axis L of the handle portion 20.

Figure 2:
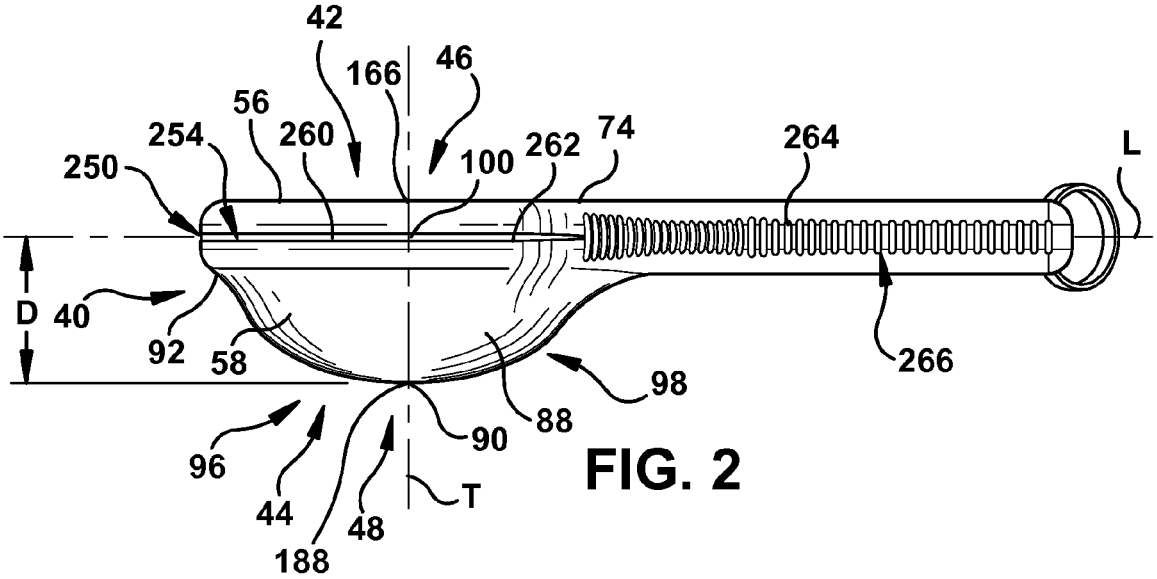
FIG. 2 is a side plan view of the paddle of FIG. 1 with the rounded top side thereof facing down.
Figure 6:
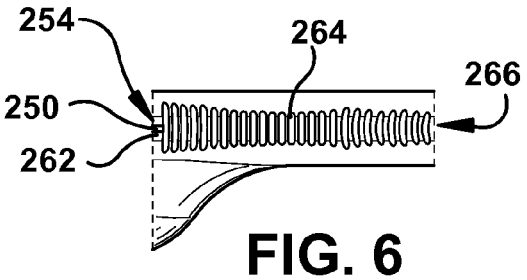
FIG. 6 is a view of the paddle of FIG. 1 taken along line 6-6 in FIG. 3.
Figure 3:
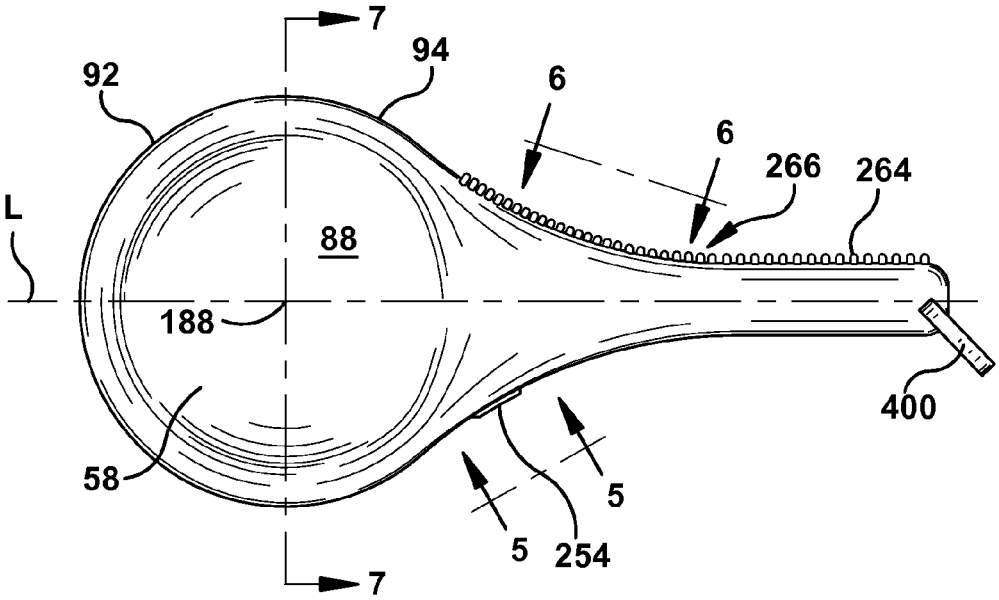
FIG. 3 is a top plan view of the paddle of FIG. 1
Figure 4:
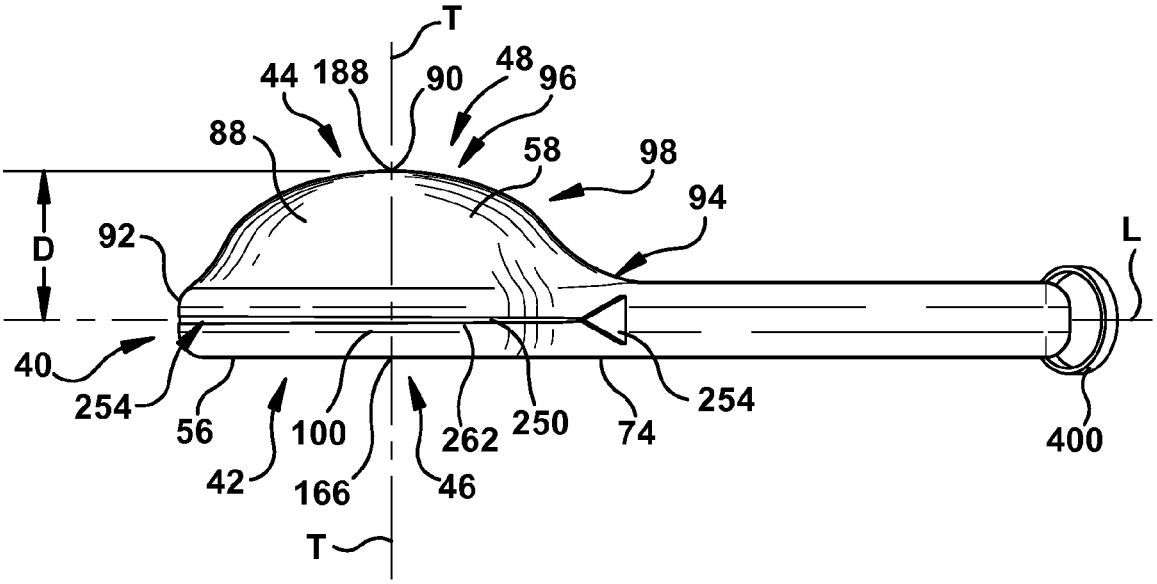
FIG. 4 is a side plan view of the paddle of FIG. 1 with the rounded top side facing up.
Figure 7:
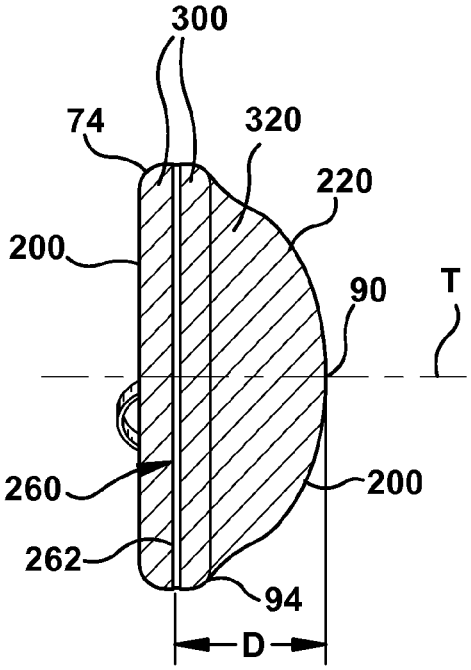
FIG. 7 is a sectional view of the paddle of FIG. 1 taken along line 7-7 in FIG. 3 showing an insert material in the rounded portion thereof.
Figure 5:
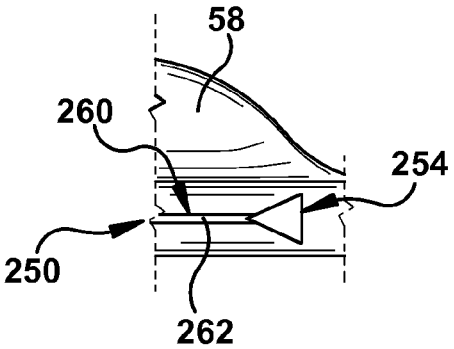
FIG. 5 is a view of the paddle of FIG. 1 taken along line 5-5 in FIG. 3.
Figure 8:
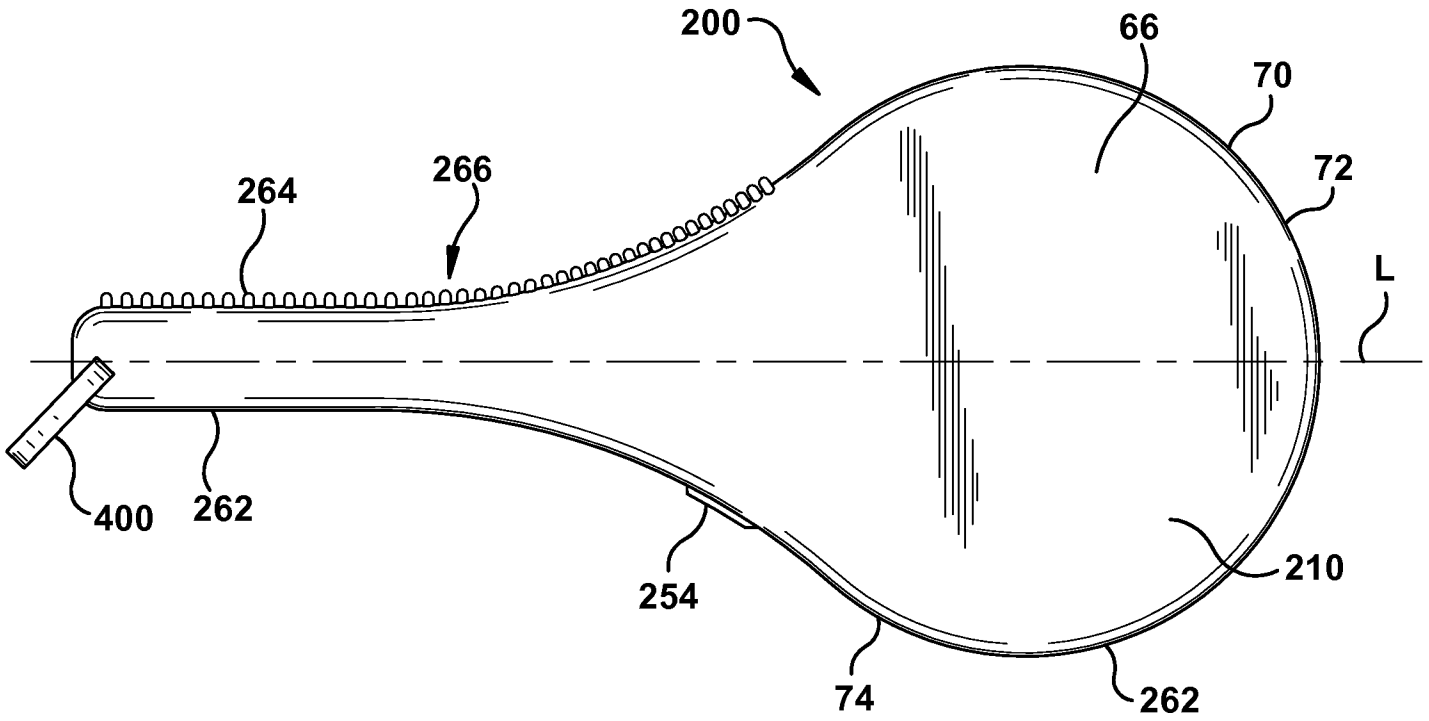
FIG. 8 is a perspective view of the flat side or bottom of the paddle of FIG. 1.

As can be seen best in FIGS. 2, 4, and 8, the first game play surface 56 is a substantially circular planar surface 66 and defines on an outer extent 70 thereof a circular edge 72 defining a first circle 74. As can be seen best in FIGS. 1-4, and 7, the second game play surface 58 is an outwardly directed substantially convex surface 88 and defines on a first outer extent 90 thereof a circular edge 92 defining a second circle 94 and, on a second outer extent 96 thereof, the surface 58 defines a domed region 98.

FIGS. 2 and 4 best illustrate a relationship between a position of the surfaces and structures in accordance with an example embodiment. In particular, the first game play surface 56 is located at a first position 100 along the longitudinal axis L relative to the handle portion 20. Also, the second game play surface 58 is located at the first position 100 along the longitudinal axis L relative to the handle portion 20. As shown, the circular planar surface 66 defines a first center point 166 at a center of the first circle 74, and the outwardly directed convex surface 88 defines a second center point 188 at a center of the second circle 94. In one example embodiment, the first center point 166 of the circular planar surface and the second center point 188 of the convex surface define a transverse axis T extending through the game play head 40 in a direction substantially perpendicular to the longitudinal axis L. Further, the first 74 and second 94 circles are overlapping and in particular embodiments coincident in the transverse axis T.

In the illustrated example embodiment, a flexible selectively removable outer shell 200 is provided. A first portion 210 of the shell 200 covers the first game play region 46 and defines the circular planar surface 66. Further, a second portion 220 of the shell 200 covers the second game play region 48 and defines the outwardly directed convex surface 88.

In one form, the flexible selectively removable outer shell 200 covers the entire game play head 40. In another form, the flexible selectively removable outer shell 200 covers the handle portion 20, the coupling region 30, and the game play head 40.

As illustrated in FIGS. 1, 2, 3, and 8, the flexible selectively removable outer shell 200 defines an elongate seam 250 configured in an embodiment to selectively pass the handle portion 20, the coupling region 30, and the game play head 40 therethrough. The flexible selectively removable outer shell 200 further includes a fastener 260, which in an example embodiment allows for selectively opening and securely closing one end of the elongate seam 250. For example, in one embodiment, fastener 260 is stitching 262 for securely closing the elongate seam 250 and includes a reinforcement member 254 for preventing the stitching from splitting or otherwise opening along the seam. It is to be appreciated that fastener 260 comprises a zipper (not shown) that may be used to provide fastening along a portion of the outer extent of the training apparatus together with stitching in the remaining portions for permitting the zippered opening portion of the outer shell 200 to be more easily opened and closed and the overall outer shell more easily removable. The zipper may extend for example along the outer extent 70 of the training apparatus 10 in the region of the game play head 40. In an example embodiment, stitching 262 extends along the entire periphery of the training apparatus 10 and may be in the form of string or thread for example or in the form of any other material as necessary or desired. In the illustrated example embodiment, lacing 264 is provided in a region 266 of the handle portion for interfacing with the fingers of an associated user during use of the device. It is to be appreciated that the location of the lacing 264 relative to the overall shape of the device as illustrated may render the subject training apparatus to be more desirable for use with left-handed users. However, the lacing 264 may be relocated to any position or region of the device as desired including, for example, to a location opposite the position shown in the Figures relative to the longitudinal axis L to adapt the training device for use by right-handed users.

FIG. 7 is a cross-sectional view of the subject training device taken through line 7-7 of FIG. 3. As seen there, the athletic paddle training apparatus 10 includes a substantially planar reinforcement member 300 disposed in the game play head 40, and a resilient compressible material 320 disposed between the planar reinforcement member 300 and the second portion 220 of the shell 200 covering the second game play region 48. In one embodiment, the substantially planar reinforcement member 300 is formed integrally with the handle portion 20 and with the coupling region 30. The planar reinforcement member 300 is generally planar and has a shape generally corresponding to the overall shape of the subject device such as shown best for example in FIGS. 3 and 8.

The subject athletic paddle training apparatus 10 according to the example embodiment illustrated further includes a wrist attachment member 400 coupled with the proximal end 24 of the handle portion 20. The wrist attachment member 400 is configured to selectively attach the paddle training apparatus 10 with a wrist of the associated user. This helps prevent the training apparatus from being thrown from the hand during use of the device such as during swinging the device. In one particular embodiment, the wrist attachment member 400 is formed of an elastic material. However, leather or any other flexible or non-flexible materials may be used as well.

Described above are example embodiments. It is, of course, not possible to describe every conceivable combination of components or methodologies for purposes of describing the example embodiments, but one of ordinary skill in the art will recognize that many further combinations and permutations of the example embodiments are possible. Accordingly, it is intended to embrace all such alterations, modifications and variations that fall within the spirit and scope of any claims filed in applications claiming priority hereto interpreted in accordance with the breadth to which they are fairly, legally and equitably entitled.

The invention claimed is:

1. An athletic paddle training apparatus comprising: an elongate handle portion defining a longitudinal axis and being configured to be gripped by an associated user;

a coupling region at a distal end of the handle portion;

a game play head operatively coupled with the handle portion at the coupling region, the game play head having first and second game play regions on opposite first and second sides thereof in a direction substantially transverse to the longitudinal axis, the first game play region defining a substantially planar first game play surface on the first side and the second game play region defining a substantially spherical second game play surface on the second side of the game play head, the first game play surface being a substantially circular planar surface defining on an outer extent thereof a circular edge defining a first circle, the second game play surface being laterally offset by a predetermined selected distance relative to the longitudinal axis of the handle portion and being an outwardly directed substantially convex surface defining on a first outer extent thereof a circular edge defining a second circle and on a second outer extent thereof, a domed region;

a substantially planar rigid reinforcement member disposed in the first game play region of the game play head; and a resilient compressible material disposed in the second game play region of the game play head.

2. The athletic paddle training apparatus according to claim 1, wherein:

the first game play surface is located at a first position along the longitudinal axis relative to the handle portion; and, the second game play surface is located at the first position along the longitudinal axis relative to the handle portion.

3. The athletic paddle training apparatus according to claim 2, wherein:

the circular planar surface defines a first center point at a center of the first circle;

the outwardly directed convex surface defines a second center point at a center of the second circle; and, the first center point of the circular planar surface and the second center point of the convex surface define a transverse axis extending through the game play head in a direction substantially perpendicular to the longitudinal axis.

4. The athletic paddle training apparatus according to claim 1, wherein: the substantially planar reinforcement member is formed integrally with the handle portion and with the coupling region.

5. The athletic paddle training apparatus according to claim 1, further comprising:

a wrist attachment member coupled with a proximal end of the handle portion, the wrist attachment member being configured to selectively attach the paddle training apparatus with a wrist of the associated user.

6. The athletic paddle training apparatus according to claim 1, wherein the resilient compressible material disposed in the game play head is formed of one or more of polyethelene, dense crepe foam, and plastic fillers.

7. The athletic paddle training apparatus according to claim 1, wherein the resilient compressible material disposed in the game play head is selectively removable from the game play head for selective replacement with a second resilient compressible material.

8. An athletic paddle training apparatus comprising:

an elongate handle portion defining a longitudinal axis and being configured to be gripped by an associated user;

a coupling region at a distal end of the handle portion; and, a game play head operatively coupled with the handle portion at the coupling region, the game play head having first and second game play regions on opposite first and second sides thereof in a direction substantially transverse the longitudinal axis, the first game play region defining a substantially planar first game play surface on the first side and the second game play region defining a substantially spherical second game play surface on the second side of the game play head, the second game play surface being laterally offset by a predetermined selected distance relative to the longitudinal axis of the handle portion, wherein the first game play surface is a substantially rigid circular planar surface defining on an outer extent thereof a circular edge defining a first circle, and wherein the second game play surface is an outwardly directed substantially compressible convex surface defining on a first outer extent thereof: a circular edge defining a second circle and on a second outer extent thereof; a domed region.

9. The athletic paddle training apparatus according to claim 8, further comprising:

a substantially planar reinforcement member disposed in the first game play region of the game play head; and, a resilient compressible material disposed in the second game play region of the game play head.

10. The athletic paddle training apparatus according to claim 9, wherein:

the substantially planar reinforcement member is formed integrally with the handle portion and with the coupling region.

11. The athletic paddle training apparatus according to claim 8, further comprising:

a wrist attachment member coupled with a proximal end of the handle portion, the wrist attachment member being configured to selectively attach the paddle training apparatus with a wrist of the associated user.

12. The athletic paddle training apparatus according to claim 8, further comprising: a resilient compressible material disposed in the game play head and within an outer shell covering the second game play region.

13. The athletic paddle training apparatus 12 wherein the resilient compressible material disposed in the game play head is formed of one or more of polyethelene, dense crepe foam, and plastic fillers.

14. The athletic paddle training apparatus 12 wherein the resilient compressible material disposed in the game play head is selectively removable from the game play head for selective replacement with a second resilient compressible material.

* * * * *